US007284295B2

(12) United States Patent
Brugora

(10) Patent No.: US 7,284,295 B2
(45) Date of Patent: Oct. 23, 2007

(54) CLEANING ELEMENT FOR BROOMS OR BRUSHES

(75) Inventor: Alessandro Brugora, Cernusco Sul Naviglio (IT)

(73) Assignee: FHP di R. Freudenberg S.a.s., Milan (IT)

( * ) Notice: Subject to any disclaimer, the term of this patent is extended or adjusted under 35 U.S.C. 154(b) by 0 days.

(21) Appl. No.: 11/393,411

(22) Filed: Mar. 30, 2006

(65) Prior Publication Data

US 2006/0218738 A1 Oct. 5, 2006

(30) Foreign Application Priority Data

Mar. 31, 2005 (EP) ..... 05425186

(51) Int. Cl.
*A46B 3/08* (2006.01)

(52) U.S. Cl. ..... 15/171; 15/202

(58) Field of Classification Search ..... None
See application file for complete search history.

(56) References Cited

U.S. PATENT DOCUMENTS 6,925,673 B2 * 8/2005 Sartori ..... 15/191.1
2004/0055100 A1 3/2004 Sartori

FOREIGN PATENT DOCUMENTS

| | | | |
|---|---|---|---|
| DE | 86 20 156 | U1 | 11/1987 |
| DE | 88 00 388 | U1 | 2/1988 |
| EP | 0 292 611 | A2 | 11/1988 |
| WO | WO 03/026460 | A1 | 4/2003 |

* cited by examiner

*Primary Examiner*—David Redding
(74) *Attorney, Agent, or Firm*—Pearne & Gordon LLP

(57) ABSTRACT

A cleaning element, in particular for brooms or brushes, comprises: a plurality of bundles of fibers, a fastening element attached to each bundle to hold the relative fibers, a support for the bundles which has an inner cavity designed to house the fastening elements and a plurality of holes for the passage of the fastening elements and the relative bundles; the support comprises a first, outer body and a second, inner body, the latter having a substantially "L"-shaped cross-section and being inserted in the first body according to a direction perpendicular to the direction of longitudinal extension of the holes; the cleaning element having parts for connecting the first body and the second body.

19 Claims, 3 Drawing Sheets

CLEANING ELEMENT FOR BROOMS OR BRUSHES

BACKGROUND OF THE INVENTION

The present invention relates to a cleaning element for brooms or brushes and in particular a cleaning element of the type comprising a plurality of clusters or bundles of fibers engaged in a supporting body.

At present, most cleaning elements of brooms and brushes comprise a supporting body or support which has a surface to which the bundles of fibers, normally bristles, are attached.

The bristles are engaged in relative blind holes made in the supporting body and the set of bundles forms a cleaning unit.

The support, in a variety of shapes, is normally made by molding synthetic material and then processed, in particular holes are drilled in the above-mentioned surface to which the bundles of bristles are attached.

Each of these blind holes forms a seat which houses a single bundle of bristles held together by a fastening element which is normally metal.

Each fastening element is forced, together with part of the bundle, into the respective hole, so as to lock each cluster to the supporting body.

However, this type of production of the cleaning element brings a disadvantage, due in particular to the possible presence of air bubbles in the supporting body, created during the molding cycle.

The bubbles, if present close to the blind holes, may cause a faulty application of the fastening element during penetration or even partial or total yielding of the hole which is no longer able to hold onto the relative bundle, resulting in gaps in the cleaning unit.

To overcome this disadvantage, supporting bodies were studied which have an inner cavity, accessible by the fastening elements by means of through-holes made in the surface for attaching the bundles of bristles.

The cavity normally has a regular contact surface opposite the attaching surface, to deform the fastening elements when they are inserted in the cavity.

In particular, as indicated in the solution described in application WO 03/026460, the supporting element cavity may be formed by two separate bodies, each having a cross-section with the shape of a "U" rotated on one side, assembled by completely inserting the flanges of one, inner body or drawer, between the flanges of the other, outer body.

The two bodies penetrate one another along a direction perpendicular to the direction of longitudinal extension of the holes used to fix the bundles of fibers.

However, the latter solution has some disadvantages.

Due to the low thicknesses involved, the flanges of the drawer may be deformed during molding, making the drawer difficult to insert in the outer body, in particular in the case of very wide supports.

Fixing and bending of the fastening elements in the cavity may not be very precise, since the fastening elements, making impact against the contact surface for deformation, may be diverted and slide along the surface, resulting in locking that is not solid or is imprecise.

Moreover, the relative fixing between the two bodies forming the cavity is preferably achieved by forcing or snapping into place, without guaranteeing suitable holding characteristics.

SUMMARY OF THE INVENTION

One aim of the present invention is, therefore, to overcome the above-mentioned disadvantages by providing an improved cleaning element which is easy to assemble.

Another aim of the present invention is to provide a cleaning element in which the fixing of the bundles is particularly solid.

Yet another aim of the invention is to provide a cleaning element in which the outer body and the drawer are joined in a solid way.

According to one aspect of it, the present invention provides an improved cleaning element for brooms or brushes as described in claim 1.

The dependent claims refer to preferred and advantageous embodiments of the invention.

BRIEF DESCRIPTION OF THE DRAWINGS

Embodiments of the present invention are now described with reference to the accompanying drawings, without limiting the scope of its application, in which.

DESCRIPTION OF THE PREFERRED EMBODIMENTS

Figure 1:
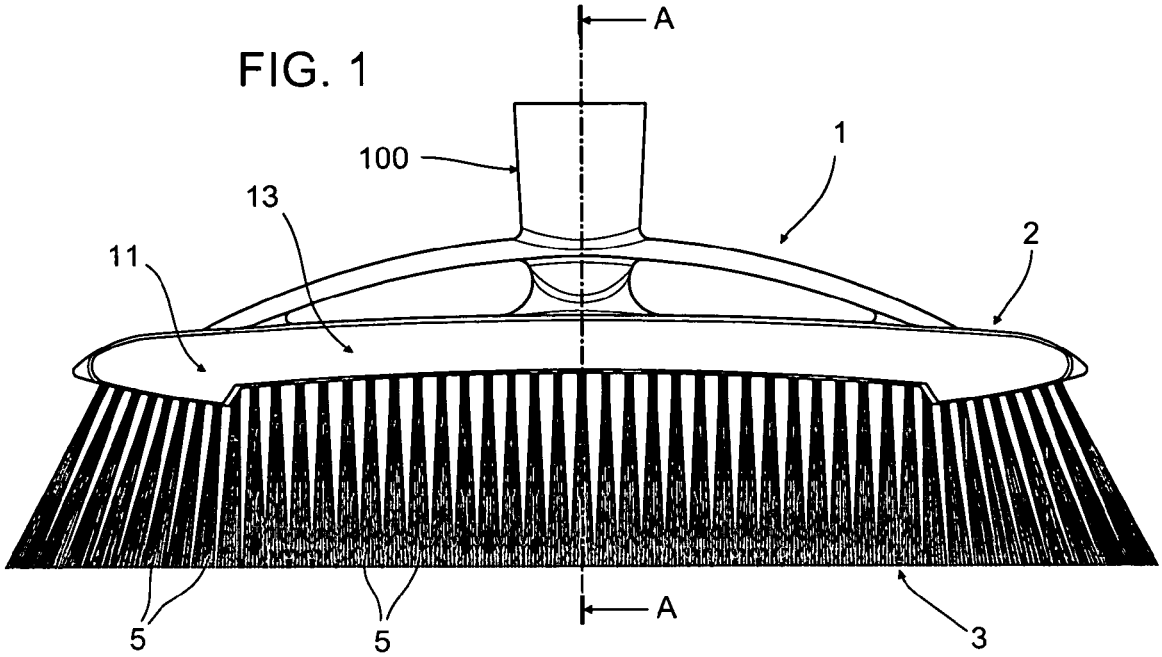
FIG. 1 is a schematic side view of a cleaning element for brooms or brushes according to the present invention.

With reference to the accompanying drawings and in particular with reference to FIG. 1, the numeral 1 denotes a cleaning element for brooms or brushes according to the present invention.

The element 1 comprises a support 2 to which a cleaning unit 3 is attached.

Figure 2:
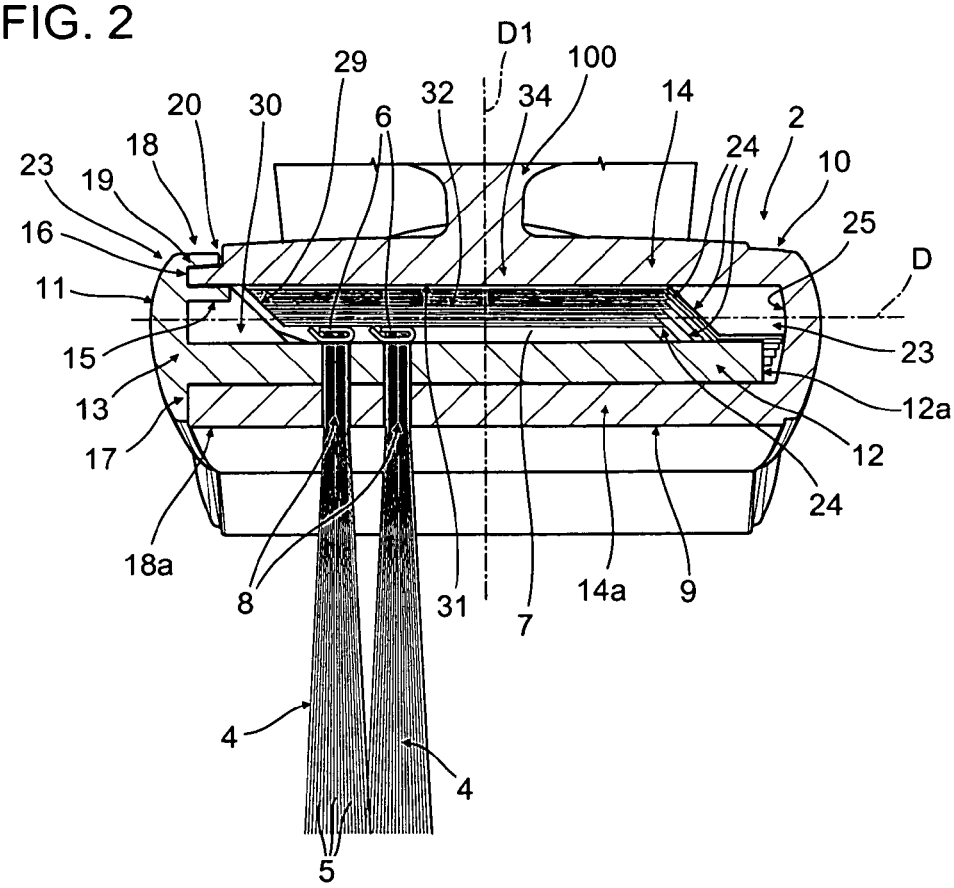
FIG. 2 is a schematic front view according to the cross section line A-A, enlarged and with some parts cut away for greater clarity, of the element illustrated in FIG. 1.

The unit 3 is formed by a plurality of bundles 4, part of which is illustrated in FIG. 2, consisting of fibers 5, in particular bristles.

The fibers 5 of each bundle 4 are held together by a respective fastening element 6 ("drop" shaped) which, deforming when the bundle 4 is attached to the support 2, keeps the bundle 4 joined to the support 2. This method for assembling the bundles to the support is substantially known and briefly covered below to allow a better understanding of the text.

The support 2 has a cavity 7 which receives the fastening elements 6, each of which passes, during the assembly step, through a respective hole 8 made in a wall 9 of the support 2.

In particular, the support 2 is formed by a first body 10 and a second body or drawer 11 inserted in the first body 10 according to a direction of insertion D perpendicular to a direction of longitudinal extension D1 of the holes 8.

It should be noticed that the holes 8, of which only a part are illustrated in FIG. 2, are made in the wall 9 once the drawer 11 has been inserted in the body 10.

FIG. 2 shows how, in cross-section, the body 10 substantially has the shape of a "U" rotated on one side and, in practice, forms the outer portion of the support 2 on three sides (again considering the cross-section).

In cross-section, the drawer 11 substantially has the shape of an "L", with a first branch 12 inserted in the body 10.

A second branch 13 of the drawer 11 substantially closes the body 10, that is to say, it is substantially perpendicular between the flanges or sides 14, 14*a* of the first body 10.

The drawer 11 structure is stiffened by suitable stiffening means 29 comprising, in the preferred embodiment illustrated, a plurality of ribs 30 joining the branch 12 and the branch 13.

The ribs 30 preferably have a triangular shape.

The ribs 30 are also, advantageously, designed to "open" the body 10 when the drawer 11 is inserted in it, particularly if the body 10 is obtained by molding.

This is because the body 10 has the flanges 14, 14*a* close together at the end of said molding and the drawer 11 moves them apart as it is inserted in the body 10.

The second body 11 has a profile 15 projecting from the branch 13 towards the inside of the cavity 7 to guarantee solid locking when the body 11 is inserted by forcing it into the body 10.

The drawer 11 also has a pair of flanges 16, 17 which extend from the branch 13 to form a stop on the free ends 18, 18*a* of the sides 14, 14*a* of the first body 10.

An edge 19 extends from the drawer 11 flange 16 to engage with the first body 10, at the end 18.

The body 10 preferably has a recess 20 for engaging with the edge 19 which, when assembly is complete, is positioned on the outside of the first body 10.

In practice, the end 18 of the side 14 is suitably shaped for insertion between the profile 15 and the edge 19.

Figure 5:
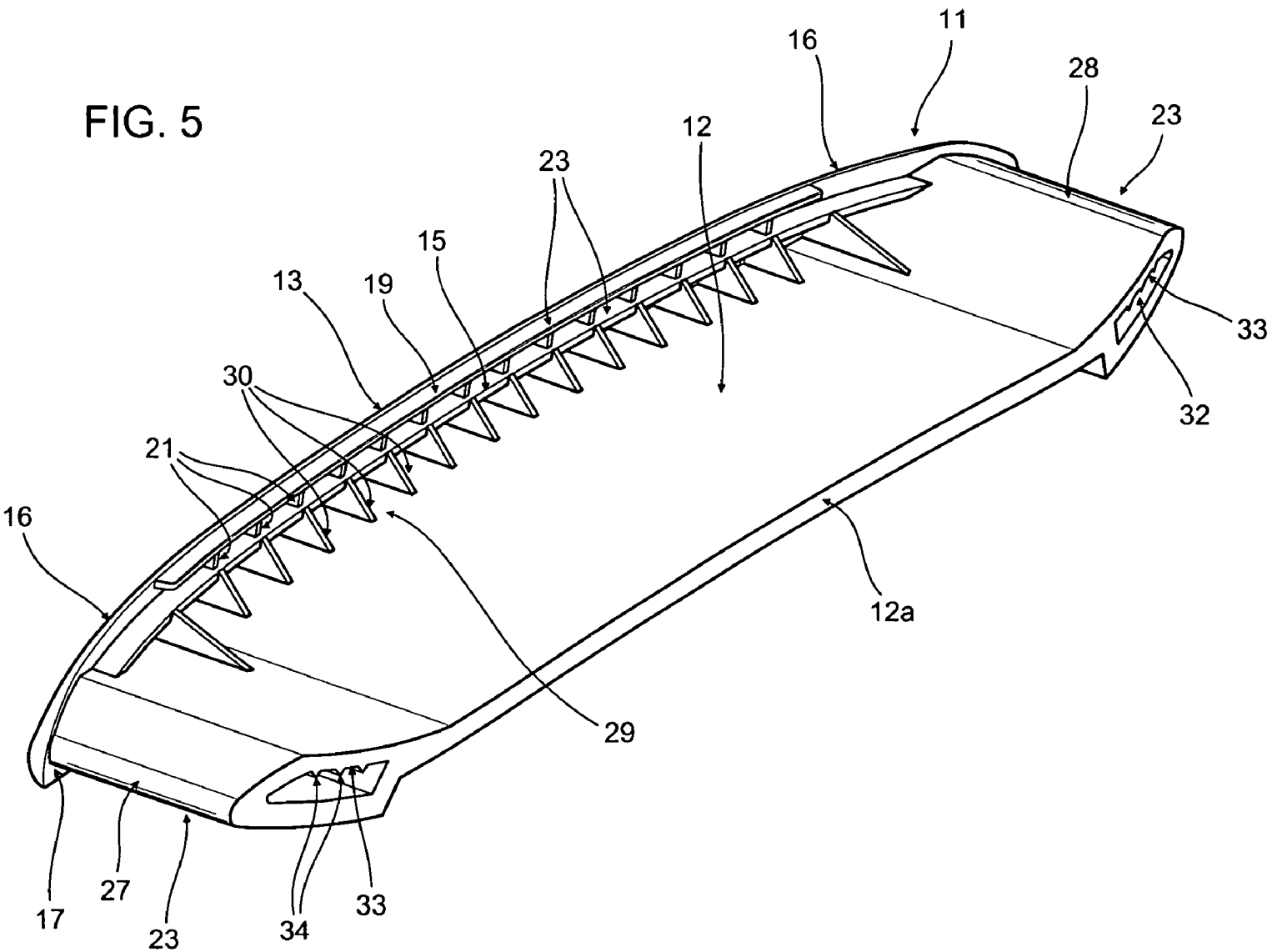
FIG. 5 is a schematic perspective view of the drawer of the cleaning element illustrated in FIGS. 1 and 2.

As illustrated in FIG. 5, the drawer 11 comprises teeth 21 located between the edge 19 and the profile 15, distributed in the groove which they form.

Figure 3:
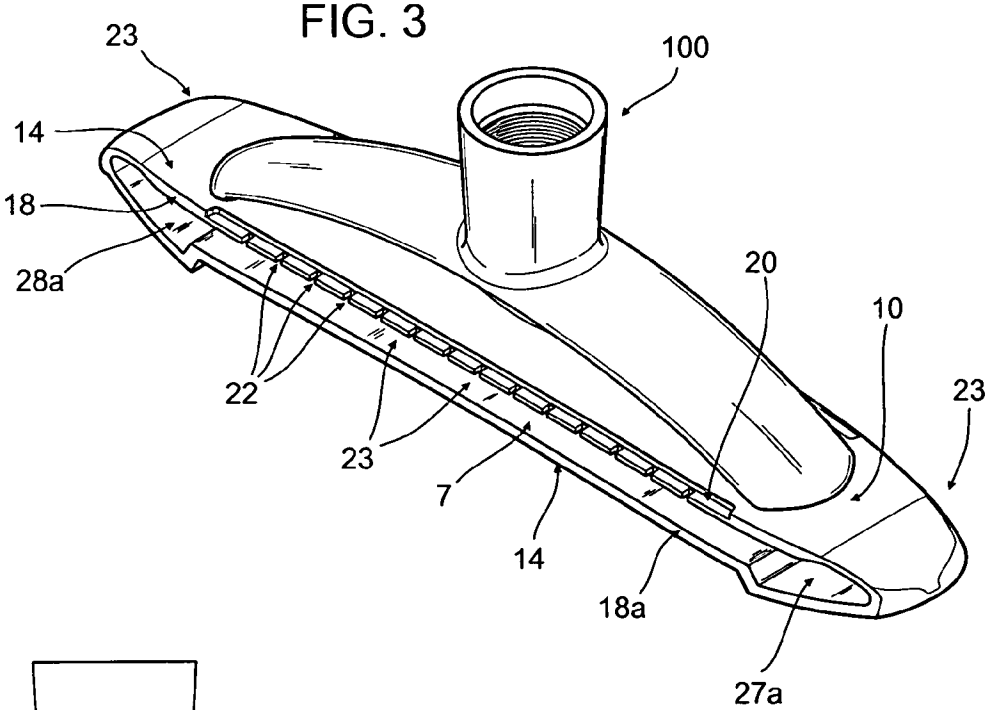
FIG. 3 is a schematic perspective view of the outer body of the cleaning element illustrated in the previous figures.

The body 10 has a set of matching slots 22 made at the end 18, visible in FIG. 3, suitable for attachment to the teeth 21.

The profile 15, the flanges 16 and 17, the edge 19, the recess 20, the teeth 21 and the slots 22 combine to form means 23 for connecting the body 10 and the drawer 11 to one another, designed to solidly join and correctly align the drawer 11 and the body 10.

Said means 23 are also designed so that, during use of the cleaning element 1, they prevent movement of the drawer 11 relative to the body 10, for example due to deformation of the body 10 during use.

It should be noticed that the drawer 11 is preferably held inside the body 10 by friction between the two.

The means 23 also comprise ribs 24 located in the body 10 between the flange 14 and its rear wall 25.

Figure 4:
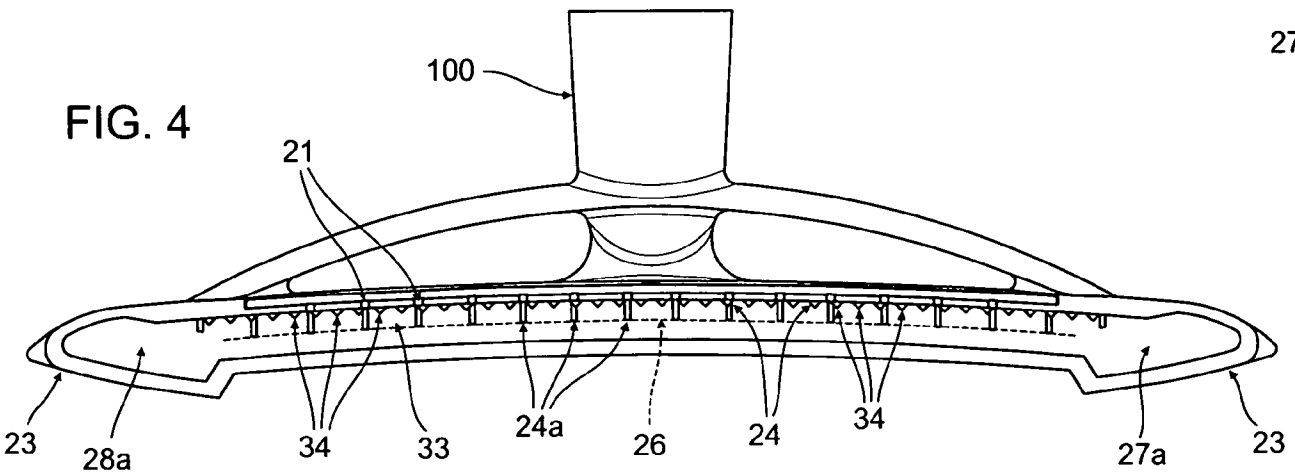
FIG. 4 is a schematic side view of the outer body illustrated in FIG. 3.

The ribs 24 each have a respective lower edge 24*a* forming a profile 26, illustrated with a dashed line in FIG. 4, for contact with the branch 12 inserted in the body 10.

In this way, the branch 12 has an end portion 12*a* stably inserted between the ribs 24 and the flange 14*a* of the body 10.

With reference to FIGS. 3 and 5, it should be noticed that, in the preferred embodiment illustrated, the connecting means 23 comprise two substantially tubular lateral portions 27, 28.

The portions 27 and 28 are attached to the drawer 11, extending laterally from the branch 12 and are closed at one end by the branch 13.

The portions are designed for insertion in special compartments 27*a*, 28*a* made in the body 10 so as to contribute to a solid connection between the drawer 11 and the body 10.

Figure 6:
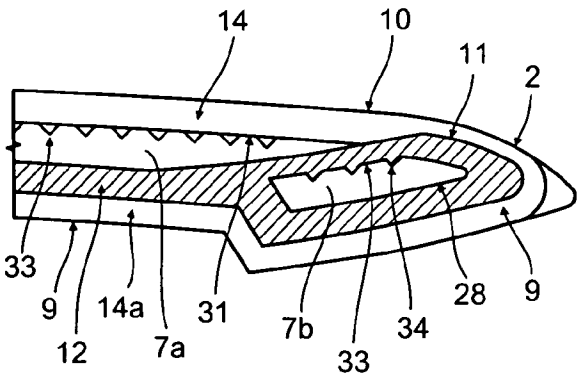
FIG. 6 is a schematic side view, suitably interrupted and partly in cross-section, with some parts cut away for greater clarity, of the element illustrated in FIG. 1.

In other words, the support 2 has the cavity 7 divided into three zones, one central 7*a* and two lateral 7*b*, of which only one is visible in FIG. 6.

As illustrated in FIGS. 2, 4 and 5, 6, the central zone 7*a* of the cavity 7 is delimited at the top by the body 10 flange 14 and at the bottom by the branch 12 and the flange 14*a*.

The lateral cavities 7*b* are delimited internally by the lateral portions 27 and 28 which are doubled, externally, by the body 10 along almost their entire length.

In this way, the overall profile cross-section of the support 2 conforms at all points, in terms of thicknesses, to guarantee correct positioning and fixing of the bundles 4 with the known techniques.

As is known, for valid assembly of the bundles 4 to the support, the latter must have predetermined proportions not described in further detail because they are not part of the present invention.

The fastening elements 6 are inserted in the cavity 7 until they are deformed against contact surfaces 31 and 33, respectively in the central zone 7*a* and in the lateral zones 7*b* of the cavity 7.

The contact surfaces 31, 33 preferably have suitable guide means 32 for the fastening elements 6, so that the latter make impact suitably with the surfaces 31, 33 and are deformed in such a way that they cannot come out of the relative holes 8.

The means 32 comprise a plurality of teeth 34 extending along the entire cavity 7, towards the inside of the cavity, both in the central zone 7*a* and in the lateral zones 7*b*. Said teeth are preferably arranged according to the direction of insertion D of the drawer 10.

The teeth 34 preferably have a triangular cross-section, to guide the fastening elements against the contact surface.

Moreover, in the preferred embodiment illustrated, the teeth 34 have an angle of approximately 90° C. at the vertex.

With reference to FIGS. 1 to 4, it should be noticed how the element 1 has means 100, of the substantially known type and therefore not described any further, for attachment to a grip for use, in particular a handle not illustrated.

A cleaning element made in this way can overcome the above-mentioned disadvantages. In particular, the substantially "L"-shaped cross-section of the inner body allows easy molding of the body, eliminating the problems of deformation and allowing its easy insertion in the outer body.

The presence of the connecting means and the lateral tubular portions contributes to a solid and precise connection between the outer body and the drawer and between bundles of fibers and the support.

The connecting means also prevent relative movements between the outer body and the drawer, in particular during use of the cleaning element.

The teeth located in the fastening element contact surfaces guarantee that the elements bend correctly.

The invention described may is suitable for evident industrial applications and may be subject to modifications and variations without thereby departing from the scope of the inventive concept. Moreover, all details of the invention may be substituted by technically equivalent elements.

What is claimed is:

1. A cleaning element, in particular for brooms or brushes, comprising: a plurality of bundles of fibers, a fastening element attached to each of the bundles to hold the relative fibers, a support for the bundles having at least one inner cavity and a plurality of holes for the passage of the bundles, the fastening elements being inserted in the cavity through the holes to hold the bundles joined to the support, the support comprising a first, outer body, having a "U"-shaped cross-section with two flanges projecting from a rear wall, and a second, inner body inserted in the first body according to a direction of insertion perpendicular to the direction of longitudinal extension of the holes, wherein the cleaning element second body, having a "L"-shaped cross-section, has only a single first branch inserted between the two flanges of the first body and a second branch, perpendicular to the first branch, closing the first body, there being connecting means operating between the first body and the second body to join them stably.

2. The element according to claim 1, wherein the connecting means comprise a profile projecting from the second branch towards the inside of the cavity to lock the second body relative to the first body.

3. The element according to claim 1, wherein the connecting means comprise at least one flange projecting from the second branch, the flange forming a stop on a free end of a side of the first body.

4. The element according to claim 1, wherein the connecting means comprise an edge attached to the second body, the edge being designed to engage with the first body.

5. The element according to claim 4, wherein, in the support, the edge is located outside the first body.

6. The element according to claim 4, wherein the first body has a recess for connection with the edge.

7. The element according to claim 1, wherein the connecting means comprise a set of slots made in the first body and a set of teeth in the second body, the teeth being designed to engage with the slots.

8. The element according to claim 1, wherein the connecting means comprise a profile located inside the first body, the profile being for contact with the first branch.

9. The element according to claim 8, wherein the profile is formed by a plurality of ribs, in particular arranged between one of the two flanges and the rear wall of the first body.

10. The element according to claim 1, wherein the second body comprises stiffening means located between the first branch and the second branch.

11. The element according to claim 10, wherein the stiffening means comprise at least one rib attached to the first branch and to the second branch.

12. The element according to claim 1, wherein the connecting means comprise two substantially tubular lateral portions attached to the second body.

13. The element according to claim 12, wherein the lateral portions extend laterally from the first branch and are closed at one end by the second branch.

14. The element according to claim 12, wherein the connecting means comprise a pair of compartments designed to hold the lateral portions, the compartments being made in the first body.

15. The element according to claim 1, wherein it has at least one contact surface for bending the fastening elements, said surface having guide means for the fastening elements, the guide means being shaped in such a way as to guide the fastening elements when they make impact against the contact surface.

16. The element according to claim 15, wherein the guide means comprise a plurality of bending teeth attached to the contact surface.

17. The element according to claim 16, wherein the teeth extend in the cavity substantially according to the direction of insertion.

18. The element according to claim 16, wherein the teeth have a triangular cross-section.

19. A cleaning element, in particular for brooms or brushes, comprising: a plurality of bundles of fibers, a fastening element attached to each of the bundles to hold the relative fibers, a support for the bundles having at least one inner cavity and a plurality of holes for the passage of the bundles, the fastening elements being inserted in the cavity through the holes to hold the bundles joined to the support, the support comprising a first, outer body, having a "U"-shaped cross-section with two flanges projecting from a rear wall, and a second, inner body, having a "L"-shaped cross-section, inserted in the first body according to a direction of insertion perpendicular to the direction of longitudinal extension of the holes, wherein the cleaning element second body has a single first branch inserted in the first body and a second branch closing the first body, there being connecting means, operating between the first body and the second body to join them stably and comprising ribs located inside the first body between one of the two flanges and the rear wall of the first body, so that the first branch of the second body being stably inserted between the ribs and the other flange of the first body.

* * * * *